US007850491B2

(12) United States Patent
Yamada

(10) Patent No.: US 7,850,491 B2
(45) Date of Patent: Dec. 14, 2010

(54) CYLINDRICAL PLUG CONNECTOR

(75) Inventor: Yoshihisa Yamada, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 176 days.

(21) Appl. No.: 12/320,032

(22) Filed: Jan. 15, 2009

(65) Prior Publication Data

US 2009/0191765 A1 Jul. 30, 2009

(30) Foreign Application Priority Data

Jan. 25, 2008 (JP) ..... 2008-014339

(51) Int. Cl.
*H01R 24/00* (2006.01)

(52) U.S. Cl. ..... 439/675

(58) Field of Classification Search ..... 439/675, 439/924.2, 668–669
See application file for complete search history.

(56) References Cited

U.S. PATENT DOCUMENTS 5,338,215 A * 8/1994 Lee et al. ..... 439/188
6,056,602 A * 5/2000 Wu ..... 439/668
6,220,898 B1 * 4/2001 Wu ..... 439/668
6,224,408 B1 * 5/2001 Wu ..... 439/188
6,450,829 B1 * 9/2002 Weisz-Margulescu ..... 439/352
6,688,918 B2 * 2/2004 Wang et al. ..... 439/668

FOREIGN PATENT DOCUMENTS

JP 53-24891 U 3/1978
JP 59-173281 U 11/1984
JP 10-022004 1/1998

OTHER PUBLICATIONS

Office Action of Japan Patent Office, Feb. 22, 2010.

* cited by examiner

*Primary Examiner*—James Harvey
*Assistant Examiner*—Vanessa Girardi
(74) *Attorney, Agent, or Firm*—Kubotera & Associates LLC

(57) ABSTRACT

A connector to be connected to a mating connector includes a housing having a receptacle recess portion for receiving the mating connector. The housing includes a regulating protrusion formed on an inner surface thereof. The connector further includes a terminal retained in the housing. The terminal includes a held portion held in the housing, a bent portion bending from the held portion, and an elastic contact portion extending from the bent portion. The elastic contact portion contacts with an outer conductive member of the mating connector and elastically deforming when the plug is inserted into the receptacle recess portion. The held portion and the bent portion have a cut portion for accommodating the regulating protrusion, so that the regulating protrusion is situated at a position for regulating the elastic contact portion.

8 Claims, 6 Drawing Sheets

CYLINDRICAL PLUG CONNECTOR

BACKGROUND OF THE INVENTION AND RELATED ART STATEMENT

The present invention relates to a connector of a jack type. More specifically, the present invention relates to a connector having a terminal with a contact portion capable of preventing an excessive deformation and damage when a mating connector is forcibly connected.

Patent Reference has disclosed a conventional connector of a jack type. The connector has two terminals. One of the terminals has a held portion held in a housing, an elastic portion bending from the held portion, and a contact portion formed on the elastic portion. When a mating plug is inserted into the connector, an outer circumferential surface presses the contact portion, so that the contact portion elastically deforms toward a circumferential wall of the housing.

Patent Reference: Japanese Patent Publication No. 10-022004

In the conventional connector described above, when the mating connector is forcibly inserted, the contact portion may be excessively deformed and damaged. To this end, in the conventional connector, the held portion of the terminal is partially cut to form a stopper piece. When the contact portion is excessively deformed toward the circumferential wall of the housing, the contact portion abuts against the stopper piece, thereby preventing the excessive deformation.

In the conventional connector, the stopper piece is formed as a part of the terminal with the contact portion. The terminal is formed of a thin metal plate, so that the contact portion easily deforms elastically. Accordingly, the stopper piece has a small thickness and low rigidity.

In the conventional connector, when the mating connector is forcibly inserted, the contact portion presses the stopper piece to generate a flexural stress. Accordingly, the stopper piece may be easily twisted, thereby making it difficult to function properly. Further, when the mating connector is forcibly inserted repeatedly, the stopper piece may be broken. When the stopper piece is broken, it is difficult to prevent the contact portion from being deformed excessively, and the contact portion may be deformed permanently or damaged.

In view of the problems described above, an object of the present invention is to provide a connector, in which it is possible to securely regulate a contact portion of a terminal at a regular position, thereby preventing the contact portion from being damaged.

Further objects and advantages of the invention will be apparent from the following description of the invention.

SUMMARY OF THE INVENTION

In order to attain the objects described above, according to the present invention, a connector includes a housing having a receptacle recess portion and a terminal having an elastic contact portion. The receptacle recess portion is formed of a circumferential wall and a bottom wall to have an opening portion for receiving a plug or a mating connector. When the plug is inserted into the receptacle recess portion, the elastic contact portion contacts with an outer conductive member of the plug and elastically deforms toward the circumferential wall.

In the connector, the terminal is inserted into an insertion hole formed in the bottom wall of the housing. The terminal includes a held portion held in the circumferential wall of the housing; a bent portion bending from the held portion at an end portion thereof on a side of the receptacle recess portion toward the bottom wall; and the elastic contact portion extending from the bent portion toward the bottom wall. The held portion and the bent portion have a cut portion with a slit shape facing the bottom wall. A regulating protrusion is formed on an inner surface of the circumferential wall of the housing to be accommodated in the cut portion when the terminal is inserted into the housing. The regulating protrusion is situated at a position for regulating the elastic contact portion to move toward the circumferential wall.

In the present invention, when the connector is assembled, the terminal is inserted into the insertion hole formed in the bottom wall of the housing. At this moment, the regulating protrusion formed on the inner surface of the circumferential wall of the housing enters the cut portion of the terminal, so that the regulating protrusion is situated at a backside of the elastic contact portion. When the connector is used, the elastic contact portion contacts with the plug or the mating connector and elastically deforms. At this moment, the elastic contact portion abuts against the regulating protrusion, thereby preventing the elastic contact portion from being deformed excessively. The elastic contact portion presses the regulating protrusion with a stress, and the stress is dispersed in the circumferential wall of the housing.

According to the present invention, it is preferred that the regulating protrusion is integrated with the housing. Accordingly, as opposed to a case that the regulating protrusion is formed as a separate component, it is possible to easily disperse the stress received on the regulating protrusion from the elastic contact portion, thereby easily preventing the regulating protrusion from being damaged. Further, it is possible to reduce a number of components and easily produce the connector.

According to the present invention, it is preferred that the regulating protrusion is formed in an area where the elastic contact portion contacts with the outer conductive member of the plug or the mating connector in an extending direction of the elastic contact portion. Accordingly, when the plug is twisted in a direction to press the elastic contact portion, the regulating protrusion abuts against the backside of the elastic contact portion in the area where the elastic contact portion contacts with the outer conductive member in the extending direction of the elastic contact portion, or the elastic contact portion receives a force from the pouter conductive member. As a result, it is possible to easily transmit the force to the regulating protrusion, and prevent the force from transmitting to the terminal other than the elastic contact portion, thereby preventing the elastic contact portion from being deformed due to the force from the outer contact member to the terminal other than the elastic contact portion.

According to the present invention, the housing may be provided with a protrusion on the inner surface of the circumferential wall at a position closer to the opening portion of the receptacle recess portion. When the connector is assembled, the protrusion enters the cut portion formed in the curved portion of the terminal. It is preferred that the protrusion is situated at a position such that an inner edge of the protrusion is flash with a surface of the curved portion at an edge of the cut portion.

Accordingly, the surface of the protrusion becomes continuous to the surface of the curved portion at the cut portion, so that the edge of the cut portion is not exposed due to a shift between the surface of the cut portion and the surface of the protrusion. When the plug or the mating connector is inserted, and a distal end portion of the plug passes over the edge of the cut portion, it is possible to prevent the distal end portion from abutting against the edge of the cut portion, thereby preventing the terminal and the plug from being damaged.

As described above, in the present invention, when the connector is assembled, the terminal is inserted into the housing. At this moment, the regulating protrusion of the housing enters the cut portion of the terminal, so that the regulating protrusion is situated at the backside of the elastic contact portion. When the connector is used, the regulating protrusion regulates the elastic contact portion.

Accordingly, the connector is easily assembled. When the connector is used, tit is possible to prevent the elastic contact portion from being deformed excessively, and to hold the elastic contact portion at a regular position. The elastic contact portion presses the regulating protrusion with the stress, and the stress is dispersed in the circumferential wall of the housing, thereby preventing the regulating protrusion from being deformed easily and being damaged.

In the present invention, the regulating protrusion is separated from the terminal. Accordingly, as opposed to a case that a part of the terminal is cut and bent to form a regulating protrusion with a plate shape, it is possible to form the regulating protrusion with sufficient rigidity.

When the elastic contact portion deforms elastically and abuts against the regulating protrusion, the regulating protrusion receives only a compressive stress, not a flexural stress, from the regulating protrusion, thereby reducing a load to the regulating protrusion. When the regulating protrusion is formed such that the regulating protrusion has a large area contacting with the elastic contact portion, it is possible to further reduce the load to the regulating protrusion.

BRIEF DESCRIPTION OF THE DRAWINGS

FIGS. 1(A) and 1(B) are views showing a connector according to an embodiment of the present invention, wherein FIG. 1(A) is a schematic perspective view of the connector, and FIG. 1(B) is a front view of the connector;

FIGS. 5(A) and 5(B) are sectional views showing the connector according to the embodiment of the present invention, wherein FIG. 5(A) is a sectional view of the connector before the ground terminal is inserted into a housing, and FIG. 5(B) is a sectional view of the connector after the ground terminal is inserted into the housing.

DETAILED DESCRIPTION OF THE PREFERRED EMBODIMENTS

Hereunder, embodiments of the present invention will be explained with reference to the accompanying drawings.

Figure 1A:
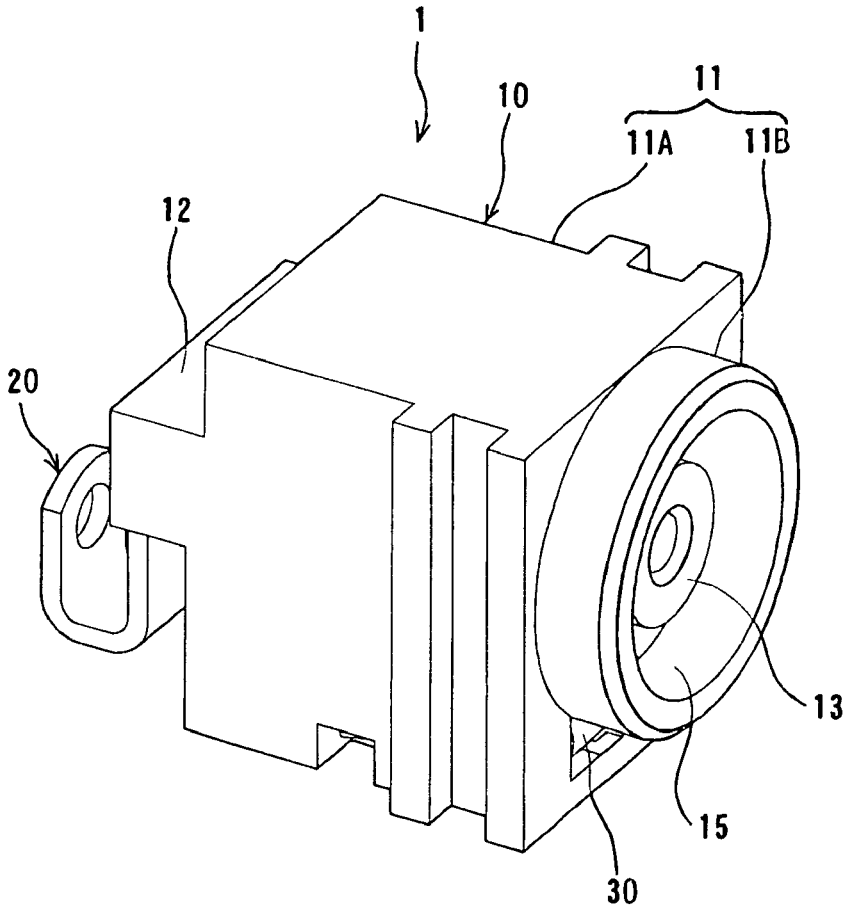
Figure 1B:
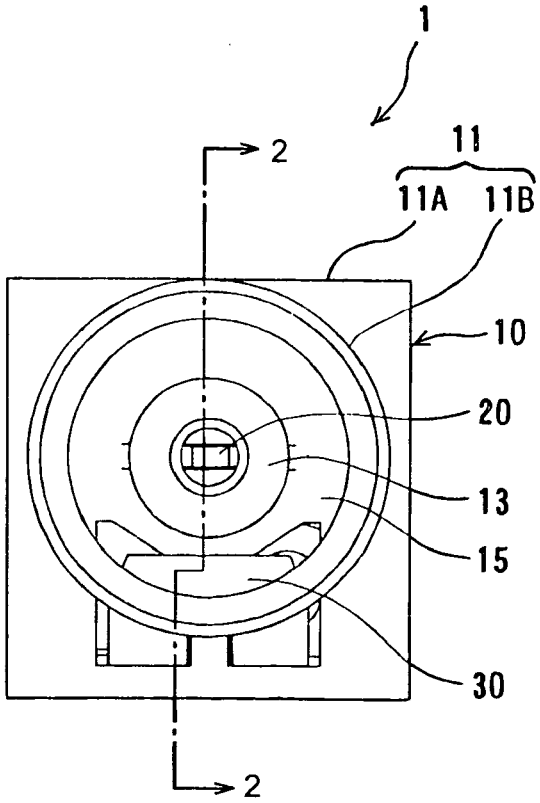

FIGS. 1(A) and 1(B) are views showing a connector 1 according to the embodiment of the present invention. More specifically, FIG. 1(A) is a schematic perspective view of the connector 1, and FIG. 1(B) is a front view of the connector 1.

Figure 2:
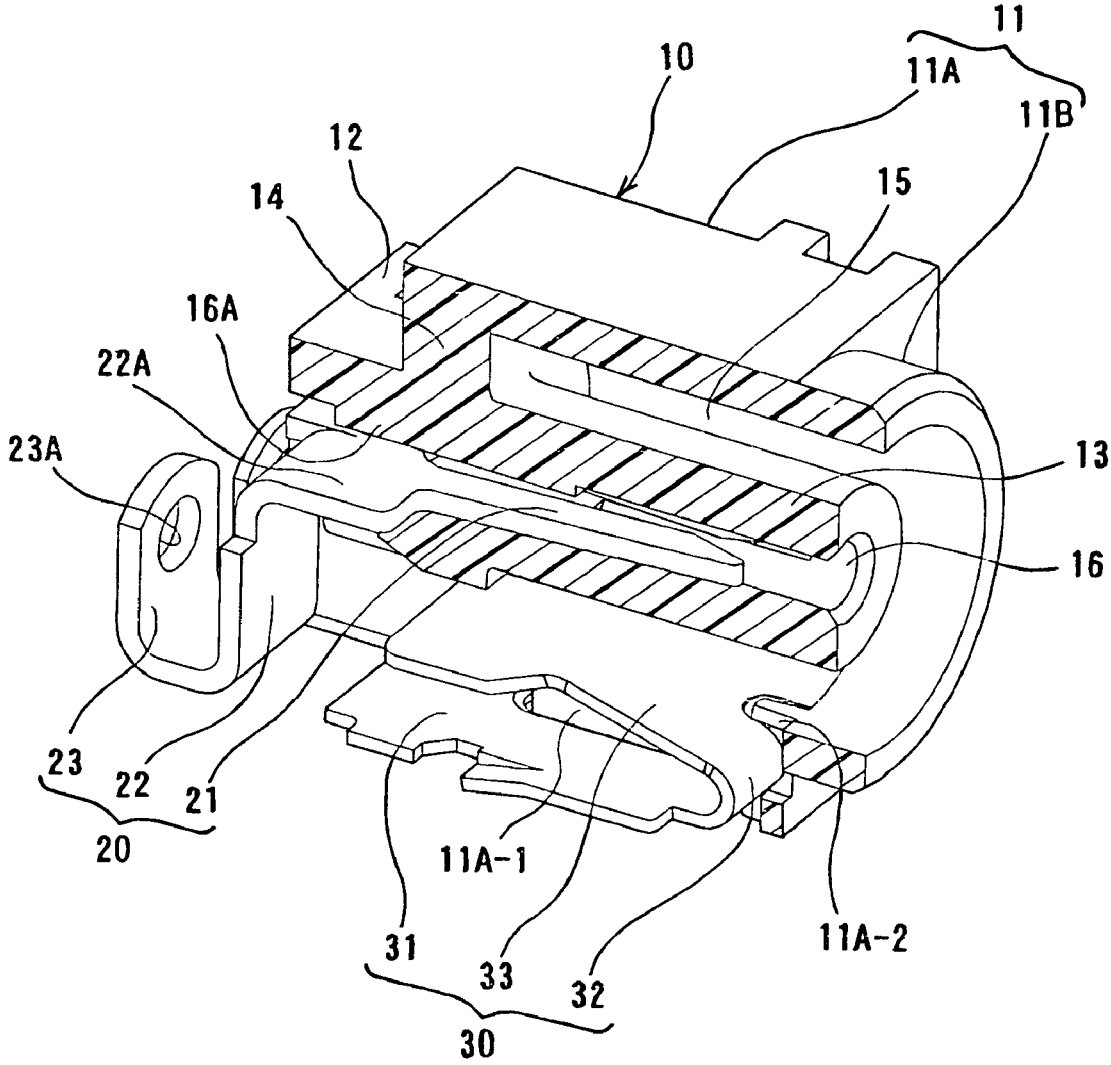
FIG. 2 is a sectional perspective view showing the connector taken along a line 2-2 in FIG. 1(B) according to the embodiment of the present invention.
Figure 3:
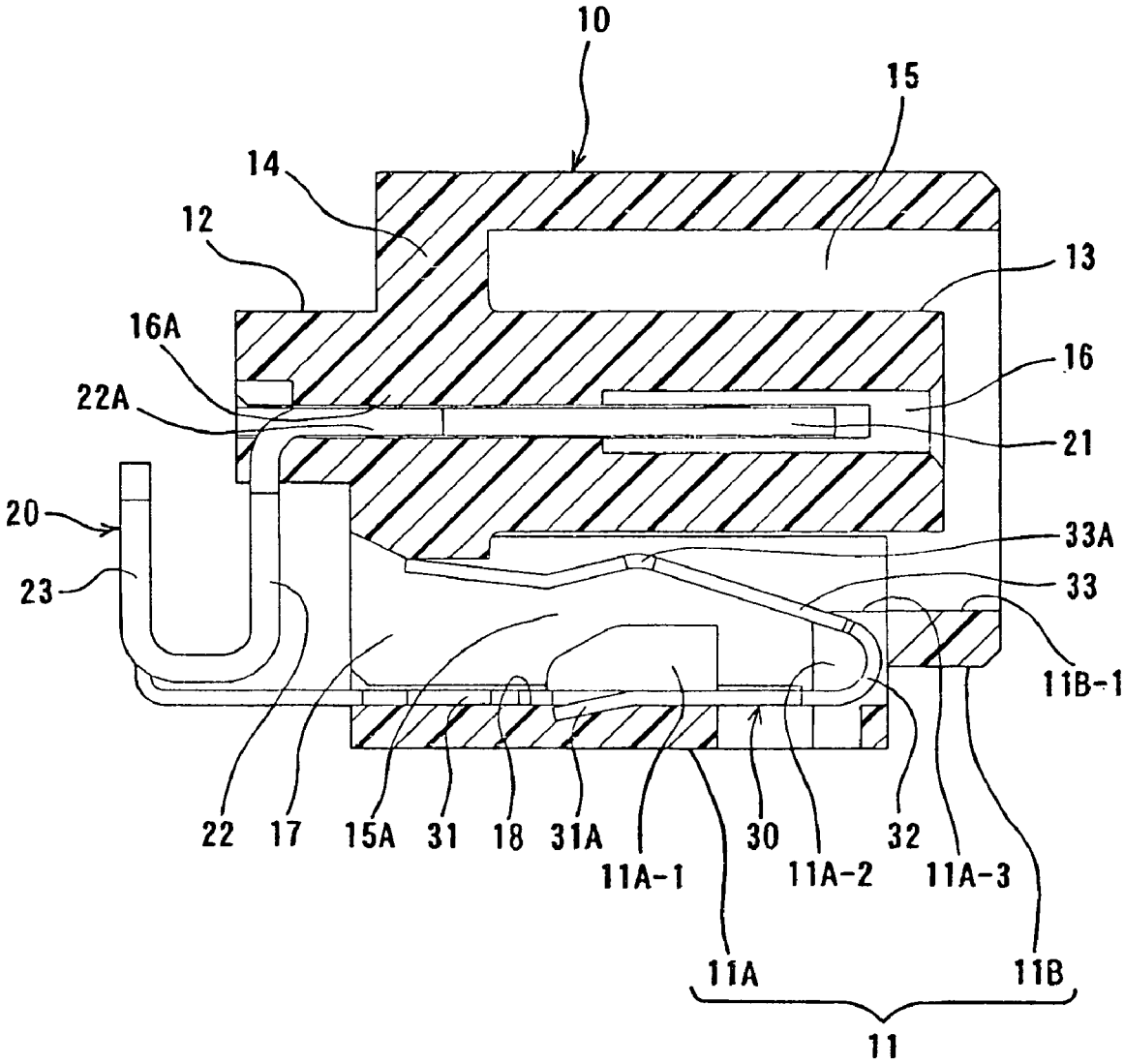
FIG. 3 is a sectional view showing the connector taken along a line 2-2 in FIG. 1(B) according to the embodiment of the present invention.

FIG. 2 is a sectional perspective view showing the connector 1 taken along a line 2-2 in FIG. 1(B) according to the embodiment of the present invention. FIG. 3 is a sectional view showing the connector 1 taken along a line 2-2 in FIG. 1(B) according to the embodiment of the present invention. In FIGS. 2 and 3, only a housing 10 is shown as sectional views, and a terminal 20 is not shown as sectional views.

A connector 1 of a jack type (connector) is connected to a plug or a mating connector (not shown). The plug includes an outer conductive member having a hollow cylindrical shape and a terminal in the outer conductive member extending coaxially with the outer conductive member. The connector 1 includes the housing 10 with an approximate rectangular solid shape and made of a synthetic resin; a terminal 20 inserted into the housing 10 from a back end (left side in FIG. 1(A)) of the housing 10 and held in the housing 10 for contacting the terminal of the plug; and a ground terminal 30 inserted into the housing 10 from the back end of the housing 10 and held in the housing 10 for contacting an outer circumferential surface of the outer conductive member of the plug.

The housing 10 includes a circumferential wall portion 11 forming a circumferential wall of the housing 10 and having an approximate rectangular solid shape with a hollow inner space. The housing 10 also includes a protruding portion 12 protruding from the circumferential wall portion 11 toward the back end thereof and an inner cylindrical portion 13 with a hollow shape located in the inner hollow space of the circumferential wall portion 11. The inner cylindrical portion 13 is formed so as to extend concentrically with the hollow space.

In the embodiment, the circumferential wall portion 11 includes an outer circumferential wall portion 11A with an approximate rectangular solid shape and a front cylindrical portion 11B protruding from a front surface of the outer circumferential wall portion 11A in a direction opposite to a protruding direction of the protruding portion 12.

As shown in FIGS. 2 and 3, the inner cylindrical portion 13 is connected to the circumferential wall portion 11 through a bottom wall 14 at a back side of the housing 10. A receptacle recess portion 15 having an approximate circular shape for receiving the plug is formed with an inner surface of the circumferential wall portion 11, an outer surface of the inner cylindrical portion 13, and an inner surface of the bottom wall 14.

As shown in FIG. 2, a terminal holding hole 16 extending in an axial direction of the inner cylindrical portion 13 is formed inside the inner cylindrical portion 13. The terminal holding hole 16 penetrates the bottom wall 14 of the housing 10. A tier portion 16A protruding in a direction perpendicular to the axis of the inner cylindrical portion 13 is formed on an inner circumferential surface of the terminal holding hole 16.

As shown in FIG. 2, the terminal 20 is formed by bending a metal plate. The terminal 20 includes a contact portion 21 extending toward a front end of the housing 10 for contacting with the terminal of the plug; a middle portion 22 having a width slightly wider than that of the contact portion 21 and being cranked to a lower direction at a back end of the contact portion 21; and a signal connecting portion 23 formed by bending toward an upper direction from the middle portion 22 for connecting with a cable (not shown).

In the embodiment, the terminal 20 is inserted into the terminal holding hole 16 of the housing 10 from the back end of the connector 1. A horizontal portion 22A of the middle portion 22 located adjacent to the contact portion 21 extends in a horizontal direction in FIG. 3. Both side end surfaces of the horizontal portion 22A are inserted into and held on an inner surface of the terminal holding hole 16. The signal connecting portion 23 includes a signal connecting hole 23A opened through the signal connecting portion 23 in a direction of a thickness of the metal plate. A cable core of the cable is connected to the signal connecting portion 23 by soldering in a state that the cable core passes through the signal connecting hole 23A.

As shown in FIG. 1(B), the circumferential wall portion 11 of the housing 10 has an external shape extending lower than a lower end of the front cylindrical portion 11B in FIG. 1(B) when the housing 10 is viewed from the front end side thereof. As shown in FIG. 3, a space is formed inside the extending portion of the circumferential wall portion 11 of the housing 10 in the lower direction. The receptacle recess portion 15 includes a circular space and the space recessed from a lower portion of the circular space in a circumferential direction thereof outwardly in a radius direction of the circular space. As shown in FIG. 3, a containing portion 15A for containing a ground terminal 30 is formed with the space and a portion of the circular space adjacent to the space.

As described later, the ground terminal 30 is contained in the containing portion 15A by inserting into the housing 10 through an insertion hole 17 formed in the bottom wall 14 of the housing 10. As shown in FIG. 3, the ground terminal 30 is held on a holding surface 18, that is, a flat lower inner surface of the outer circumferential wall 11A forming the containing portion 15A.

In the embodiment, a regulating protrusion 11A-1 protruding from the holding surface 18 is formed on the holding surface 18 in order to regulate a deformation of an elastic contact portion 33 of the ground terminal 30 toward the holding surface 18. The regulating protrusion 11A-1 is formed by molding integrally with the outer circumferential wall 11A. Regulation of the deformation of the ground terminal 30 by the regulating protrusion 11A-1 will be described later with reference to FIG. 6.

In the embodiment, on the holding surface 18, as shown in FIG. 3, a protrusion 11A-2 protruding from the holding surface 18 at a position closer to an opening portion of the receptacle recess portion 15 is formed by molding integrally with the outer circumferential wall 11A. The protrusion 11A-2 is attached to the outer circumferential wall 11A and the front cylindrical portion 11B. Further, an upper surface of the protrusion 11A-2 in FIG. 3, in other words, an inner edge surface 11A-3, is situated at the same level with a lower inner surface 11B-1 of the front cylindrical portion 11B.

Figure 4:
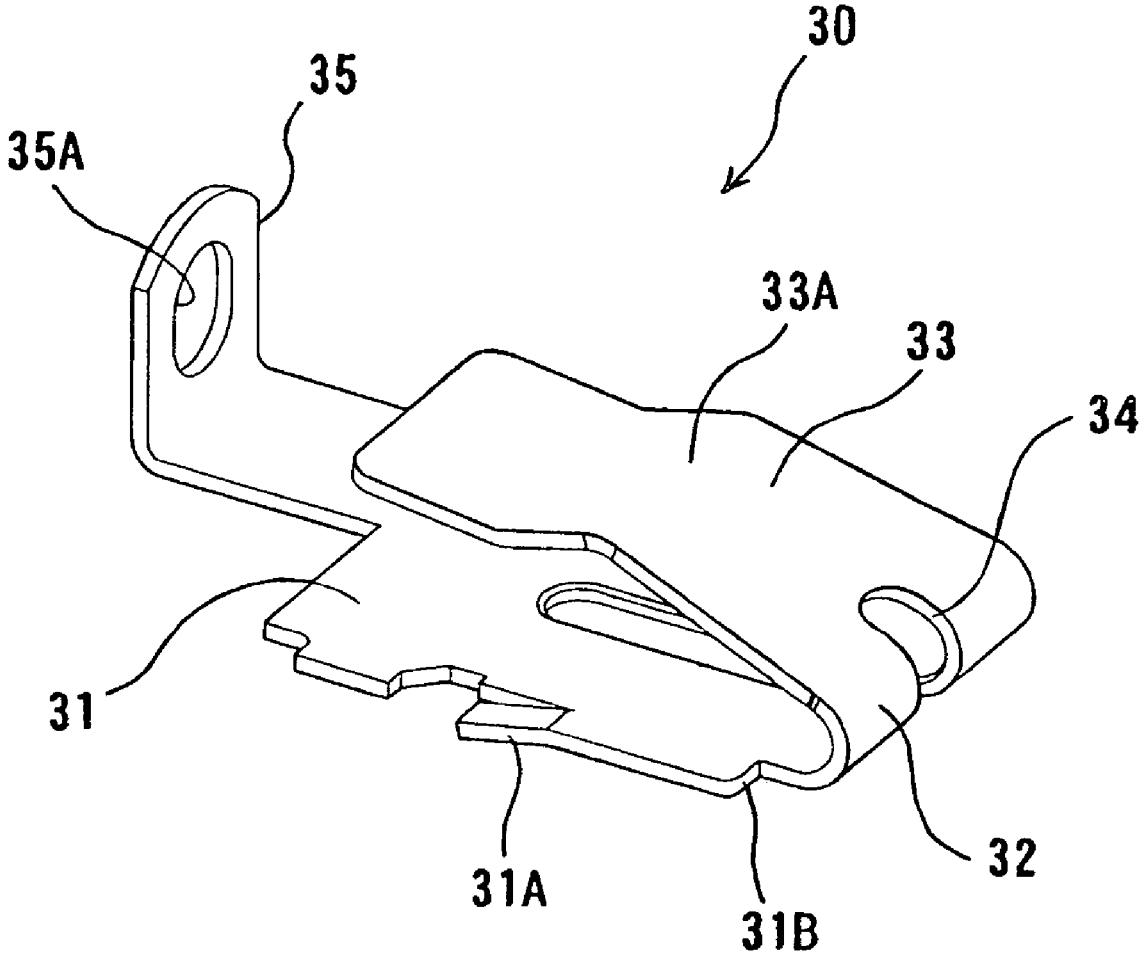
FIG. 4 is a perspective view showing a ground terminal of the connector according to the embodiment of the present invention.

As shown in FIG. 4, the ground terminal 30 is formed by bending a metal plate toward a direction of a thickness of the metal plate. The ground terminal 30 includes a held portion 31 having a flat plate shape and held by the holding surface 18 of the housing 10; a bent portion 32 bent upwardly from a front side (a right side in FIG. 4) of the held portion 31; and an elastic contact portion 33 extending from the bent portion 32 toward a rear side of the held portion 31. A cut portion 34 having a slit shape is formed in the held portion 31 and the bent portion 32 at a center portion thereof in a width direction thereof, and extends from the bent portion 32 toward the rear side of the held portion 31. As shown in FIG. 4, the elastic contact portion 33 has a top portion 33A (described later) formed by bending an approximate middle portion of the elastic contact portion 33 into a mountain shape.

The held portion 31 includes a lock portion 31A (described later) at a side end edge thereof formed by bending a part of the side end edge toward a lower direction in FIG. 4. Further, as shown in FIG. 4, the held portion 31 includes a shoulder portion 31B with a ledge shape (described later) at a front part of the side end edge thereof. A ground connecting portion 35 is formed to extend from a rear end edge part of the held portion 31 in an opposite direction of the bent portion 32 and bend an end part thereof in the upper direction for connecting with a cable (not shown). The ground connecting portion 35 includes a ground connecting hole 35A opened through the ground connecting portion 35 in the direction of the thickness of the metal plate. A cable core of a ground cable is connected to the ground connecting portion 35 by soldering in a state that the cable core passes through the ground connecting hole 35A.

Figure 5A:
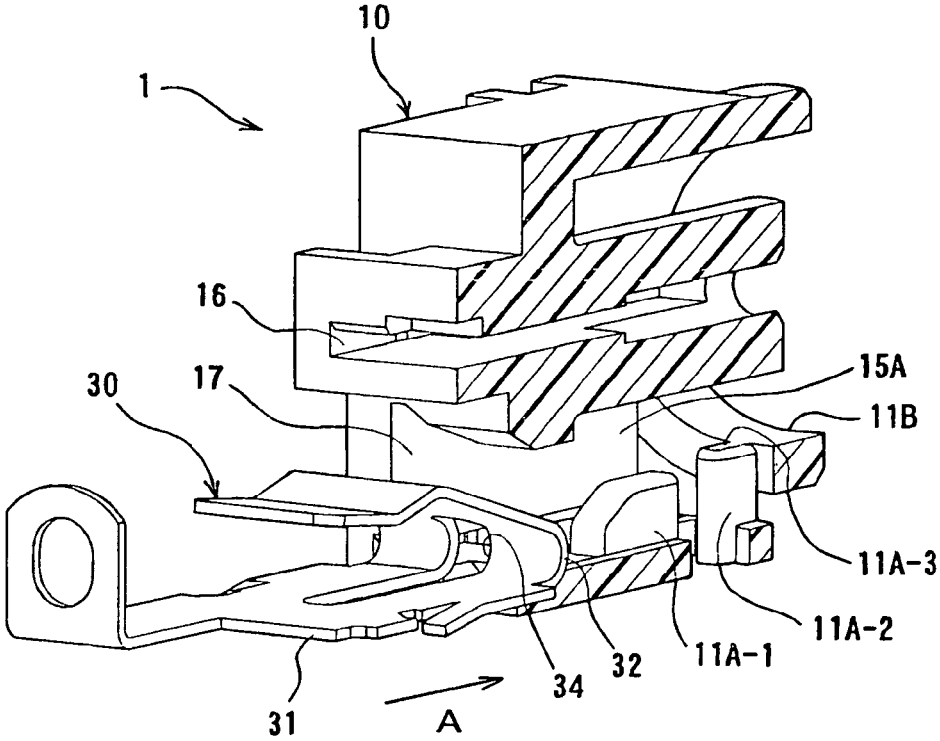
Figure 5B:
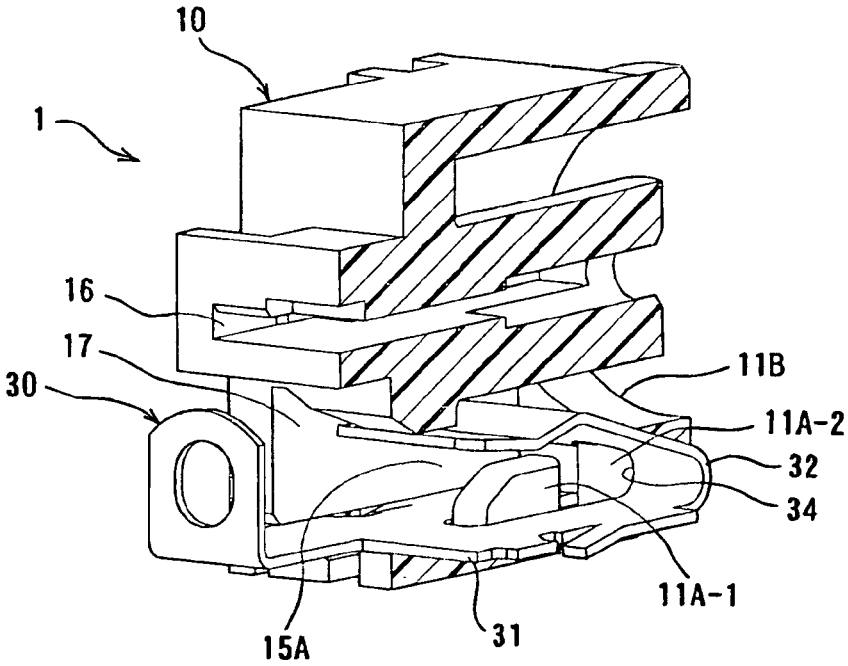

FIGS. 5(A) and 5(B) are views showing a setting procedure of the ground terminal 30 into the housing 10. More specifically, FIG. 5(A) is a view showing a state before the setting procedure starts, and FIG. 5(B) is a view showing when the setting procedure is completed. FIGS. 5(A) and 5(B) are the perspective views of the connector 1 viewed from behind. In FIGS. 5(A) and 5(B), the signal terminal 20 is omitted.

As shown in FIG. 5(A), the ground terminal 30 is inserted toward a front side (in an arrow direction A) into the insertion hole 17 from where the bent portion 32 is formed. When the ground terminal 30 is inserted into the containing portion 15A of the housing 10 through the insertion hole 17, the regulating protrusion 11A-1 formed on the holding surface 18 of the housing 10 enters the cut portion 34 from the front side thereof.

As shown in FIG. 5(B), when the regulating protrusion 11A-1 reaches to a far end of the cut portion 34 on the held portion 31, the setting procedure of the ground terminal 30 is completed. When the setting procedure is completed, a front end edge portion of the shoulder portion 31B of the held portion 31 engages with a tier portion (not shown) formed on an inner side surface of the containing portion 15A. Accordingly, a movement of the ground terminal 30 toward the front direction can be regulated more efficiently.

As shown in FIG. 3, when the insertion and setting of the ground terminal 30 is completed, the lock portion 31A of the ground terminal 30 engages with a tier portion on the holding surface 18 of the housing 10. Thus, it is possible to prevent the ground terminal 30 from coming off. In addition, as shown in FIG. 3, the regulating protrusion 11A-1 extends in an extending direction of the elastic contact portion 33, that is, a front to rear direction of the connector 1 within an area where the top portion 33A is included. Further, similar to the ground connector 30, the signal terminal 20 is inserted into the terminal holding hole 16 from a back end of the housing 10 toward the front end and set into the housing 10, thereby completing the connector 1.

When the ground terminal 30 is set into the containing portion 15A, the protrusion 11A-2 of the housing 10 enters a front part of the cut portion 34 of the ground terminal 30 from the front.

In the embodiment of the present invention, when the protrusion 11A-2 enters the cut portion 34, the inner edge surface 11A-3 of the protrusion 11A-2 is situated at a level substantially the same as that of the bent portion 32 at an edge of the cut portion 34. That is, the inner edge surface 11A-3 of the protrusion is flush with a surface of the bent portion 32. Accordingly, the edge of the cut portion 34 is not exposed due to a shift between the inner edge surface 11A-3 of the protrusion 11A-2 and the surface of the bent portion 32.

When the plug or the mating connector is inserted through the opening portion of the receptacle recess portion 15 of the housing 10, and a distal end portion of the plug passes through around the edge of the cut portion 34, it is possible to prevent the distal end portion of the plug from abutting against the edge of the cut portion 34. Accordingly, it is possible to prevent the ground terminal 30 and the plug from being damaged due to the abutting.

Figure 6:
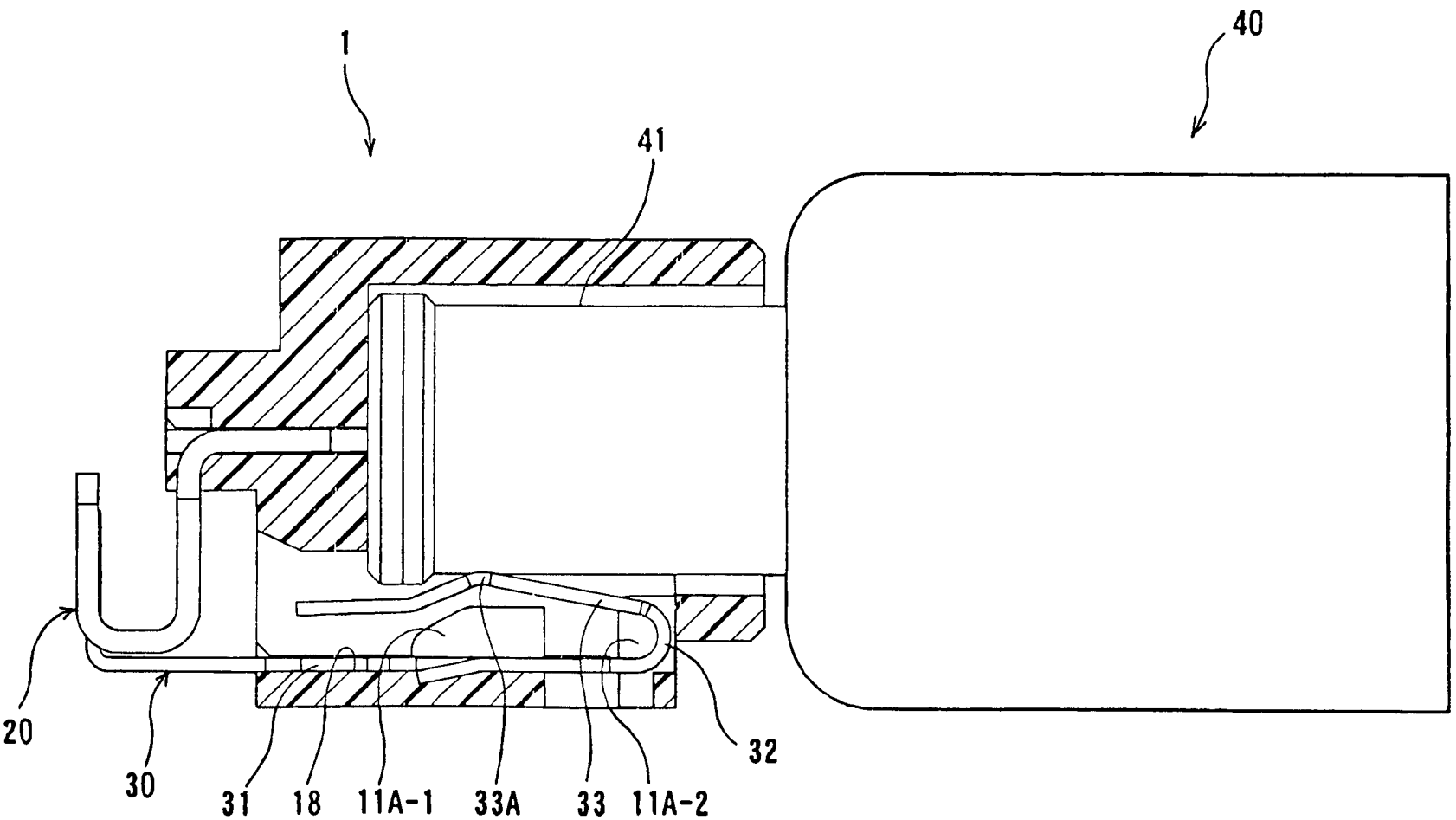
FIG. 6 is a partial sectional view showing the connector connected to a mating connector according to the embodiment of the present invention.

FIG. 6 is a partial sectional view showing the connector 1 connected to the plug or the mating connector according to the embodiment of the present invention. When the distal end portion of the plug 40 is inserted into the receptacle recess portion 15 from the front side, a terminal (not shown) of the plug 40 enters into the terminal holding hole 16 and contacts with the contact portion 21 of the signal terminal 20 of the connector 1. Thus, the connector 1 and the plug 40 are conducted electrically.

In addition, when the distal end portion of the plug 40 is inserted into the receptacle recess portion 15 of the connector 1, as shown in FIG. 6, an outer conductive member 41 of the plug 40 contacts with the top portion 33A of the elastic contact portion 33 and conducts electrically with the ground terminal 30. The outer conductive member 41 also deforms the elastic contact portion 33 elastically toward the holding surface 18, i.e., toward the lower direction in FIG. 6.

As shown in FIG. 6, when the plug 40 is twisted in a direction to press the elastic contact portion 33 as the plug 40 is inserted or pulled off, the outer conductive member 41 of the plug 40 presses the elastic contact portion 33 of the ground terminal 30 to a lower position than a position shown in FIG. 6.

In the embodiment, the regulating protrusion 11A-1 is situated at the backside of the elastic contact portion 33 or a lower side in FIG. 6. Accordingly, when the elastic contact portion 33 is pressed by the twisting of the plug 40, the backside of the elastic contact portion 33 abuts against the regulating protrusion 11A-1, thereby further regulating the elastic deformation of the elastic contact portion 33. As a result, the regulating protrusion 11A-1 regulates an excessive deformation of the elastic contact portion 33, and the elastic contact portion 33 can be regulated at a regular position. Accordingly, it is possible to prevent the ground terminal 30 from a permanent deformation or being damaged.

In the embodiment, the regulating protrusion 11A-1 is formed on the holding surface 18 of the housing 10. When the plug 40 is forcibly inserted, a stress is generated in the regulating protrusion 11A-1 as the regulating protrusion 11A-1 receives a force from the elastic contact portion 33 of the ground terminal 30. The stress can be dispersed in the circumferential wall of the housing 10. Accordingly, the regulating protrusion 11A-1 is rigid and not deformed permanently or damaged easily.

When the regulating protrusion is formed by cutting and bending a part of the held portion 31 of the ground terminal 30 as a conventional connector, the regulating protrusion has a plate shape standing perpendicularly. When an upper end surface of the regulating protrusion abuts against the elastic contact portion 33, a force from the elastic contact portion 33 is loaded on a relatively small area of the upper end surface of the regulating protrusion, thereby increasing the load on the regulating protrusion. Further, the regulating protrusion can be affected easily by a flexural stress. Thereby, the regulating protrusion may be broken by receiving the force from the elastic contact portion 33.

In the embodiment, the regulating protrusion 11A-1 is separated from the ground terminal 30. Thus, the regulating protrusion can be formed with a sufficient length in the front to rear direction of the connector 1 or a crosswise direction in FIG. 6. Thereby, it is possible to form the regulating protrusion 11A-1 with a sufficient rigidity. Accordingly, the regulating protrusion 11A-1 receives only a compressive stress, not the flexural stress.

Further, in the embodiment, as compared to a case that a part of the held portion 31 of the ground terminal 30 is cut and bent to form a regulating protrusion, the regulating protrusion is formed to have a large contacting area with the elastic contact portion 33, thereby reducing the load to the regulating protrusion 11A-1. Accordingly, it is possible to prevent the regulating protrusion 11A-1 from being deformed permanently and being damaged easily.

In the embodiment, the regulating protrusion 11A-1 is integrated with the housing 10. Accordingly, as opposed to a case that the regulating protrusion 11A-1 is formed as a separate component, it is possible to easily disperse the stress loaded onto the regulating protrusion 11A-1 from the elastic contact portion 33, thereby further reducing the load to the regulating protrusion 11A-1. As a result, it is possible to prevent the regulating protrusion 11A-1 from being damaged or deformed permanently. Further, it is possible to reduce a number of components and easily produce the connector 1.

When the regulating protrusion is formed as a component separated from the housing and the regulating protrusion has the sufficient contacting area with the holding surface of the circumferential wall, the stress loaded on the regulating protrusion from the elastic contact portion also can disperse easily. Accordingly, as described above, it is possible to prevent easily the regulating protrusion from being damaged by reducing the force loaded onto the regulating protrusion.

In the embodiment of the present invention, as shown in FIG. 6, the regulating protrusion 11A-1 is formed in the area including the top portion 33A of the elastic contact portion 33 as a contact point with the outer conductive member 41 of the plug 40 in the extending direction of the elastic contact portion 33. Accordingly, when the plug 40 is twisted in a direction to press the elastic contact portion 33, the regulating protrusion 11A-1 abuts against the backside of the top portion 33A receiving the force directly from the outer conductive member 41. As a result, the force against the top portion 33A from the outer conductive member 41 can be directly transmitted from an area around the top portion 33A of the elastic contact portion 33 to the regulating protrusion 11A-1. Thus, it is possible to prevent the elastic contact portion 33 from being deformed and being damaged by transmitting the force from the outer conductive member 41 to the terminal portion other than the top portion 33A of the elastic contact portion 33.

When the elastic contact portion 33 is formed with a sufficient rigidity, the force can be transmitted to the regulating protrusion without the deformation or the damage described above. Accordingly, when the elastic contact portion has the sufficient rigidity, the elastic protrusion may not be located in the area including the top portion 33A of the elastic contact portion 33. In this case, it is necessary to form the regulating protrusion so that at least a part of the regulating protrusion is located in an area including the elastic contact portion. The force against the top portion 33A from the outer conductive member 41 can be transmitted to the regulating protrusion when the regulating protrusion is formed in an area where the elastic contact portion can contact thereto as the plug is twisted and press the elastic contact portion.

The disclosure of Japanese Patent Application No. 2008-014339, filed on Jan. 25, 2008 is incorporated in the application by reference.

While the invention has been explained with reference to the specific embodiments of the invention, the explanation is illustrative and the invention is limited only by the appended claims.

What is claimed is:

1. A connector to be connected to a mating connector, comprising:

a housing having a receptacle recess portion for receiving the mating connector, said housing including a regulating protrusion formed on an inner surface thereof; and a terminal retained in the housing, said terminal including a held portion held in the housing, a bent portion bending from the held portion, and an elastic contact portion extending from the bent portion, said elastic contact portion contacting with an outer conductive member of the mating connector and elastically deforming when the mating connector is inserted into the receptacle recess portion, said held portion and said bent portion having a cut portion for accommodating the regulating protrusion so that the regulating protrusion is situated at a position for regulating the elastic contact portion.

2. The connector according to claim 1, wherein said regulating protrusion is integrated with the housing.

3. The connector according to claim 1, wherein said regulating protrusion is formed in an area where the elastic contact portion contacts with an outer conductive member of the mating connector in an extending direction of the elastic contact portion.

4. The connector according to claim 1, wherein said receptacle recess portion is formed of a circumferential wall and a bottom wall of the housing to have an opening portion for receiving the mating connector.

5. The connector according to claim 4, wherein said terminal is inserted into an insertion hole formed in the bottom wall of the housing.

6. The connector according to claim 4, wherein said housing further includes a protrusion on the inner surface thereof at a position closer to the opening portion than the regulating protrusion.

7. The connector according to claim 6, wherein said protrusion is accommodated in the cut portion formed in the bent portion.

8. The connector according to claim 6, wherein said protrusion is situated at a position so that an inner edge of the protrusion is flush with a surface of the bent portion at an edge of the cut portion.

* * * * *